US007004466B2

(12) United States Patent
Gauselmann

(10) Patent No.: US 7,004,466 B2
(45) Date of Patent: Feb. 28, 2006

(54) DETERMINING THE VALUE OF A JACKPOT AWARD IN A GAMING MACHINE

(75) Inventor: Paul Gauselmann, Espelkamp (DE)

(73) Assignee: adp Gauselmann GmbH, Lübbecke (DE)

( * ) Notice: Subject to any disclaimer, the term of this patent is extended or adjusted under 35 U.S.C. 154(b) by 281 days.

(21) Appl. No.: 10/157,098

(22) Filed: May 28, 2002

(65) Prior Publication Data

US 2002/0180152 A1 Dec. 5, 2002

(30) Foreign Application Priority Data

May 29, 2001 (DE) ..... 101 25 968.9
Feb. 28, 2004 (DE) ..... 102 08 943.4

(51) Int. Cl.
*A63F 1/18* (2006.01)

(52) U.S. Cl. ..... 273/139; 463/20; 463/25

(58) Field of Classification Search ..... 273/292, 273/138.1, 139; 463/12–13, 16–20, 25–27
See application file for complete search history.

(56) References Cited

U.S. PATENT DOCUMENTS 5,344,144 A * 9/1994 Canon ..... 463/27
5,564,700 A 10/1996 Celona
5,626,341 A 5/1997 Jones et al.
5,645,486 A 7/1997 Nagao et al.
5,743,800 A * 4/1998 Huard et al. ..... 463/26
5,779,547 A * 7/1998 SoRelle et al. ..... 463/28
6,033,307 A * 3/2000 Vancura ..... 463/20
6,062,981 A * 5/2000 Luciano, Jr. ..... 463/26
6,312,334 B1 * 11/2001 Yoseloff ..... 463/25
6,386,977 B1 * 5/2002 Hole ..... 463/26
6,416,406 B1 * 7/2002 Duhamel ..... 463/12
6,565,436 B1 * 5/2003 Baerlocher ..... 463/26
6,712,695 B1 * 3/2004 Mothwurf et al. ..... 463/25
2002/0151353 A1 * 10/2002 Gauselmann ..... 463/25
2002/0183109 A1 * 12/2002 McGahn et al. ..... 463/20

FOREIGN PATENT DOCUMENTS

DE 198 14 553 C1 11/1999
DE 199 27 132 A1 6/2000
DE 100 04 150 A1 8/2001
EP 874337 A1 * 10/1998
GB 2210191 A * 6/1989
GB 2222712 A * 3/1990
WO WO 99/03078 1/1999
WO WO 00/17825 3/2000
WO WO 01/10523 A1 2/2001

OTHER PUBLICATIONS

European Search Report, 3 pages.

* cited by examiner

*Primary Examiner*—Chanda L. Harris
*Assistant Examiner*—Alex F. R. P. Rada, II
(74) *Attorney, Agent, or Firm*—Patent Law Group LLP

(57) ABSTRACT

The present invention relates to a method of determining the value of a jackpot award. The method entails operating a main game to obtain an outcome, at least one of the outcomes providing an initial award amount and enabling a secondary game. A player is then allowed to wager the initial award amount in the secondary game. The secondary game then identifies a winning or losing outcome. The winning outcome results in an increase of the initial award amount by some incremental amount. The player may continue to wager all or a portion of the won amount until the player has achieved the full jackpot award.

26 Claims, 6 Drawing Sheets

DETERMINING THE VALUE OF A JACKPOT AWARD IN A GAMING MACHINE

FIELD OF INVENTION

The invention is related to gaming machines and, in particular, to a method of determining the value of a jackpot award.

BACKGROUND

From the German magazine "Munzautomat," December 1998 issue, page 135, a jackpot system is known that comprises a housing with a jackpot display on the front. Several gaming machines are connected to the jackpot system. One disadvantage of this device is that after the jackpot is triggered, the value of the jackpot is set to zero and that thereafter for a long period of time the player is not motivated to play because of the low jackpot award.

SUMMARY

The present invention relates to a method of determining the value of a jackpot award in a gaming machine. The method entails operating a main game to obtain an outcome, where at least one of the outcomes, such as a jackpot outcome, enables a secondary game. In one example of the secondary game, a full jackpot amount is displayed along with an initial percentage of the jackpot that the player has just won. Either the main game or the secondary game may determine the initial percentage and the full jackpot value. The player may then accept the initial percentage or wager that amount in the secondary game. If the player chooses to wager that amount, the secondary game determines whether the player wins or loses the wager. If the player wins, the player wins the wagered amount, and the secondary game then continues. The player can keep wagering all or a portion of the amount won in the secondary game until the full jackpot value is reached or exceeded, or until the player no longer has credits to play the secondary game, or until the player decides to quit.

In one embodiment, portions of each bet in the main game are sent to both a visible jackpot and a hidden jackpot. When a player wins the visible jackpot, instead of the jackpot going down to zero, all or a portion of the hidden jackpot is used as the starting visible jackpot amount. In this way, players are still enticed to play the game by the starting jackpot amount.

DETAILED DESCRIPTION

Figure 1:
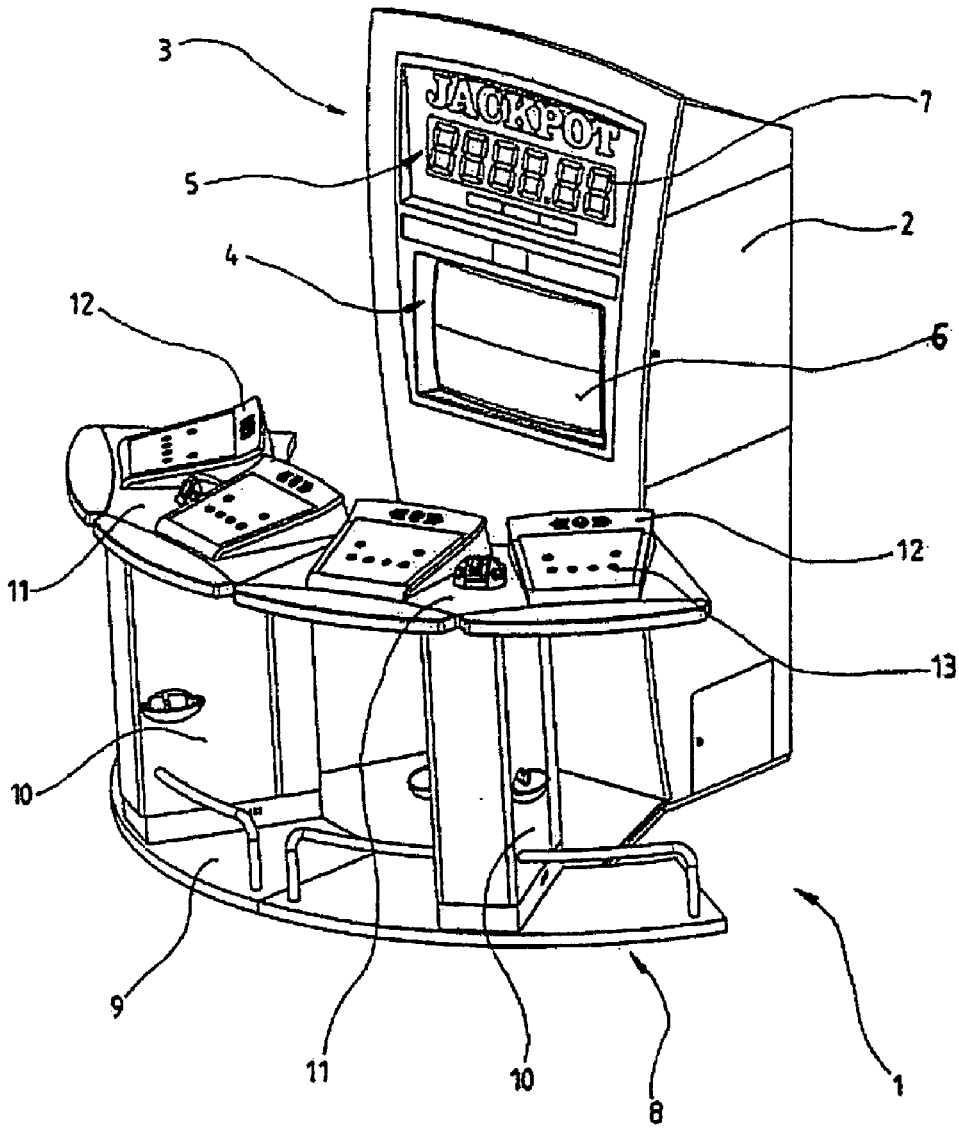
FIG. 1 is a perspective view of a gaming device in accordance with one embodiment of the present invention.

FIG. 1 is a gaming device 1 comprising a housing 2. Housing 2 comprises a front 3 with two openings 4 and 5, where a CRT 6 and a jackpot display device 7 are respectively positioned. A control unit 8 coupled to the housing 2 comprises a base plate 9 and two upright elements 10. Each of upright elements 10 comprises a plate 11 with control consoles 12 having control elements 13.

Figure 2:
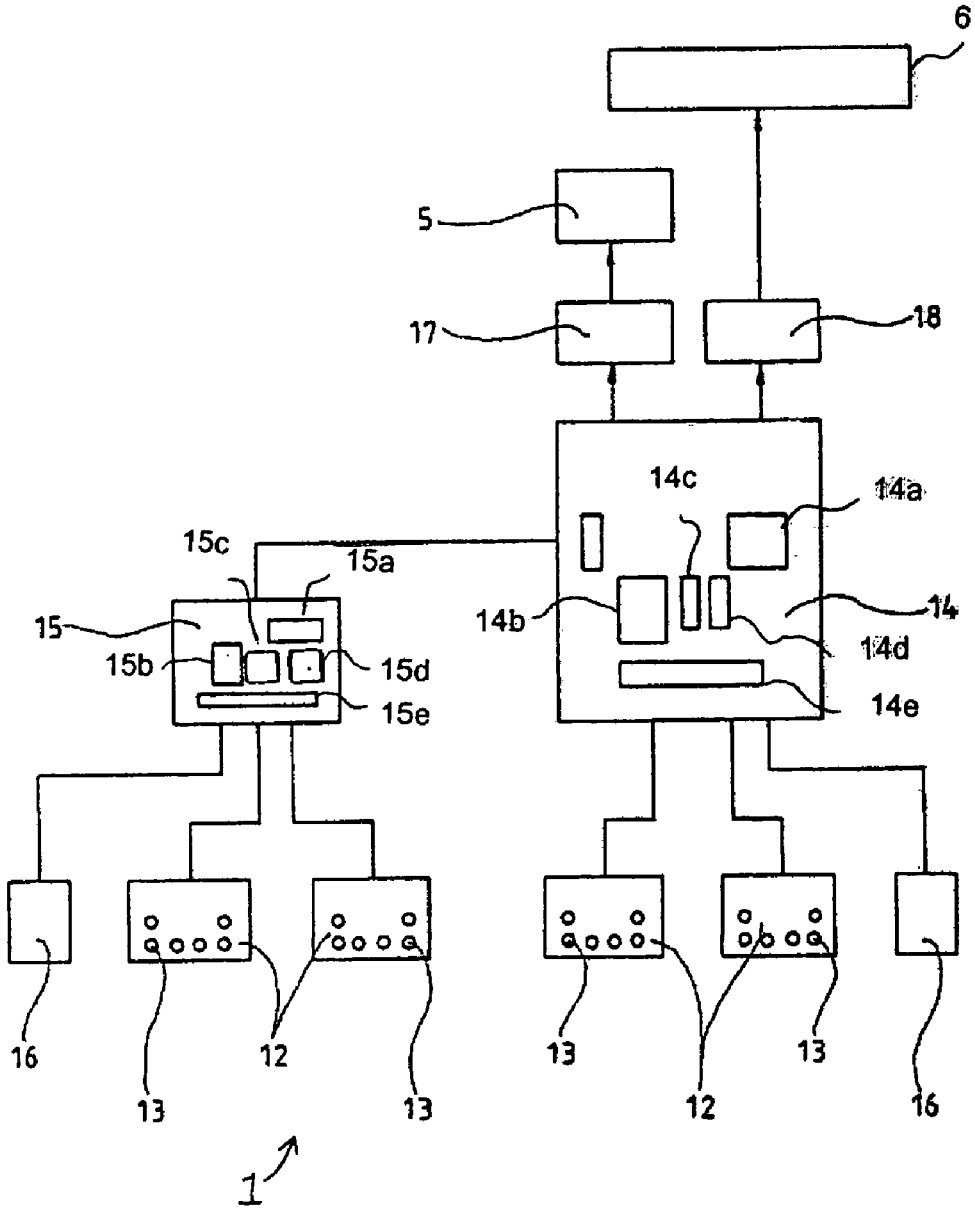
FIG. 2 is a block diagram of the embodiment shown in FIG. 1.

In each upright element 10 there are control units, shown in FIG. 2 as control units 14 and 15. Both control units are linked to each other. One of the control units is the master and the other is the slave. The master controls jackpot display device 7 and CRT 6. As can be seen in FIG. 1, the availability of multiple consoles 12 allows a number of players to play gaming device 1.

FIG. 1 is an exemplary embodiment and may be varied. For example, instead of display device 7 and CRT 6, a single display device such as a CRT or an LCD display may be used. The single display device may be separated into two regions, one for displaying game symbols and the other for displaying the jackpot amount. Furthermore, housing 2, control unit 8, and control console 12 may be combined into a single gaming terminal that may be played by a single player. Each gaming terminal may comprise its own display device 7 and CRT 6.

FIG. 2 is a block diagram of gaming device 1. Gaming device 1 comprises a master control unit 14 and a slave control unit 15 located in upright elements 10 (FIG. 1). Control consoles 12 comprise six control elements 13 that are connected to the control units 14 and 15. Using a CRT controller 17 and a display controller 18, master control unit 14 operates CRT 6 and display device 7, respectively.

A coin/credit detector 16 is connected to each control unit 14 and 15. Each coin/credit detector 16 may comprise a coin verifier, a bill validator, and a read/write device for cards (e.g., credit cards, smart cards, or printed tickets with bar codes). A dispenser to issue coins and/or bills upon a player cashing out may be employed. Alternatively, the player may be issued a paper ticket to redeem for cash, or another form of cashless transaction may be used.

Each control unit 14 and 15 is a micro-computer with an input-output device to communicate with peripheral devices (e.g., control elements 13, lights in control console 12, etc.). The micro-computers comprise a microprocessor (14*a* and 15*a*), a hard disk ROM (14*b* and 15*b*), memory RAM (14*c* and 15*c*), a timing circuit, a battery (14*d* and 15*d*), and a bus system comprising a data-, memory-, address- and control bus (14*e* and 15*e*). Control units 14 and 15 may be connected to a network. In an alternative embodiment, a single control unit may be used instead of two control units 14 and 15.

On the hard disk ROM 14*b* of control unit 14, all the game information may be stored (e.g., pseudo random number generator, monitor driver, pay tables, game programs). During a game, pseudo random numbers generated by control unit 14 are determined and stored in RAM 14*c*. All generated values during the game are also stored in RAM 14*c* (e.g., remaining credits available to a player). Master control unit 14 uses a pseudo random number generator stored in hard disk ROM 14*b* to determine the time to trigger a jackpot and which symbol combination will be generated to trigger the jackpot.

The value of the jackpot is displayed using jackpot display device 7. Every time a player inputs money into the coin/credit device 16 (or plays a credit), control unit 14 distributes the value to the actual (visible) jackpot displayed on display device 7 and to a background jackpot stored in hard disk 14*b*. The background jackpot is not displayed to a player, but is used to partially replenish the actual jackpot when a payout is made from the actual jackpot.

When the gaming device 1 has sufficient credits and play is initiated, control unit 14 determines a combination of symbols using a pseudo random number generator and displays the symbols on CRT 6. Examples of games include simulated rotating reels, where the reels are randomly stopped to obtain a symbol combination, or a card game such as Blackjack. A player may control the game using control elements 13 in control consoles 12. For example, in the case of a Blackjack game, a player may operate control elements 13 to draw additional cards.

Figure 3:
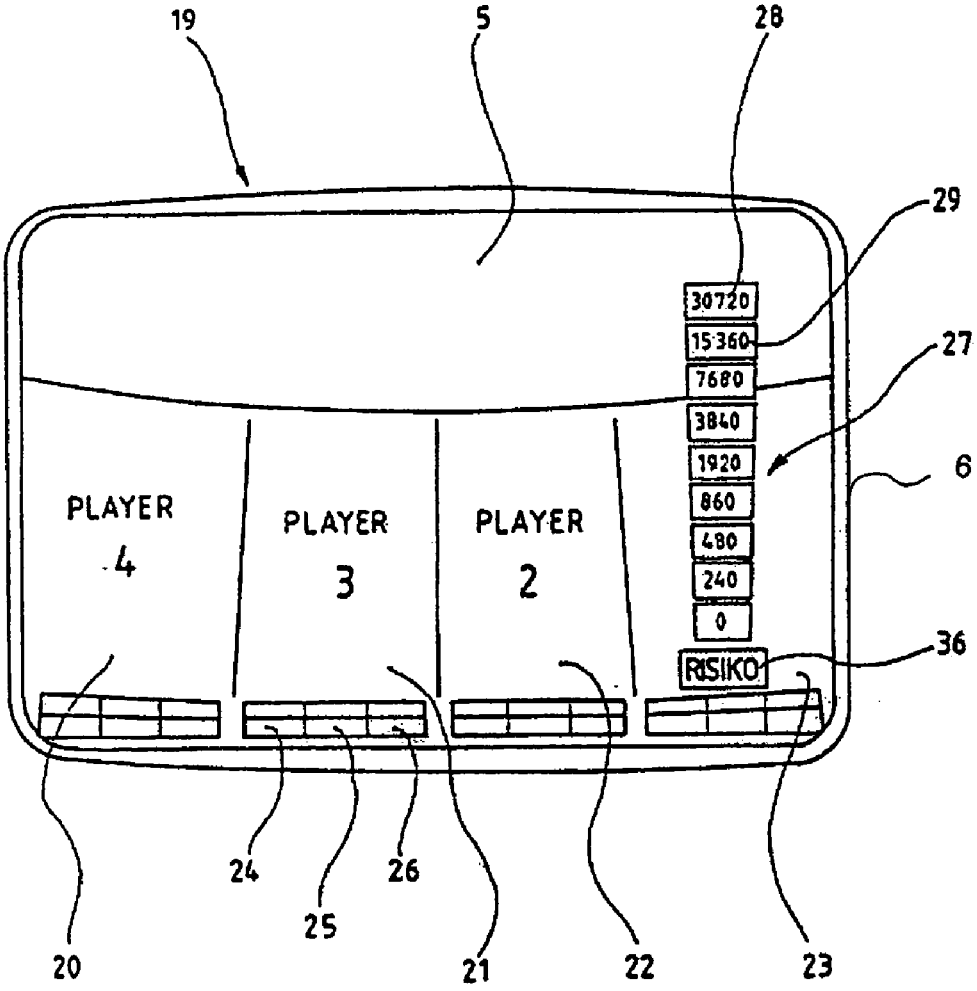
FIG. 3 is a display showing a jackpot game in accordance with one embodiment of the present invention.

FIG. 3 shows one example of the display by CRT 6 (FIG. 1). The display is divided into four regions, regions 20, 21, 22, and 23. Each region corresponds to a control console 12 and to an individual player using a control console 12. In one embodiment, these regions are used for displaying the Blackjack hands; in another embodiment, the regions may display game reels with indicia. Displayed in the lower part of regions 20, 21, 22, and 23 are display fields 24, 25 and 26 showing the actual score, the bet, and the remaining credits, respectively.

If a jackpot is triggered, all symbols (e.g., playing cards) disappear, and the player who has won the jackpot can see the possible awards in a win ladder 27, as is shown in region 23 in FIG. 3. Win ladder 27 may take any suitable form. The highest step 28 of win display 27 is the full jackpot amount. Each award 29 on ladder 27 is about half the value of the next step. The number of steps required to obtain the full jackpot depends on the value of the full jackpot and the value that is initially won by having achieved the jackpot trigger combination. In the example of FIG. 3, the player's initial win of 860 credits for achieving a triggering combination causes the player to be five steps from winning the full jackpot amount.

The player may then risk the current award amount in order to gain the next higher award amount. To do this the player selects the "RISIKO" icon 36 in FIG. 3, and a random number generator determines if the player wins (moves up the ladder 27) or loses. The game proceeds until the player loses or has achieved the jackpot. In one embodiment, the game ends when the player loses once. In another embodiment, the game ends when the player goes down to zero credits on ladder 27. The main game (e.g., Blackjack) may then be started again.

Figure 4:
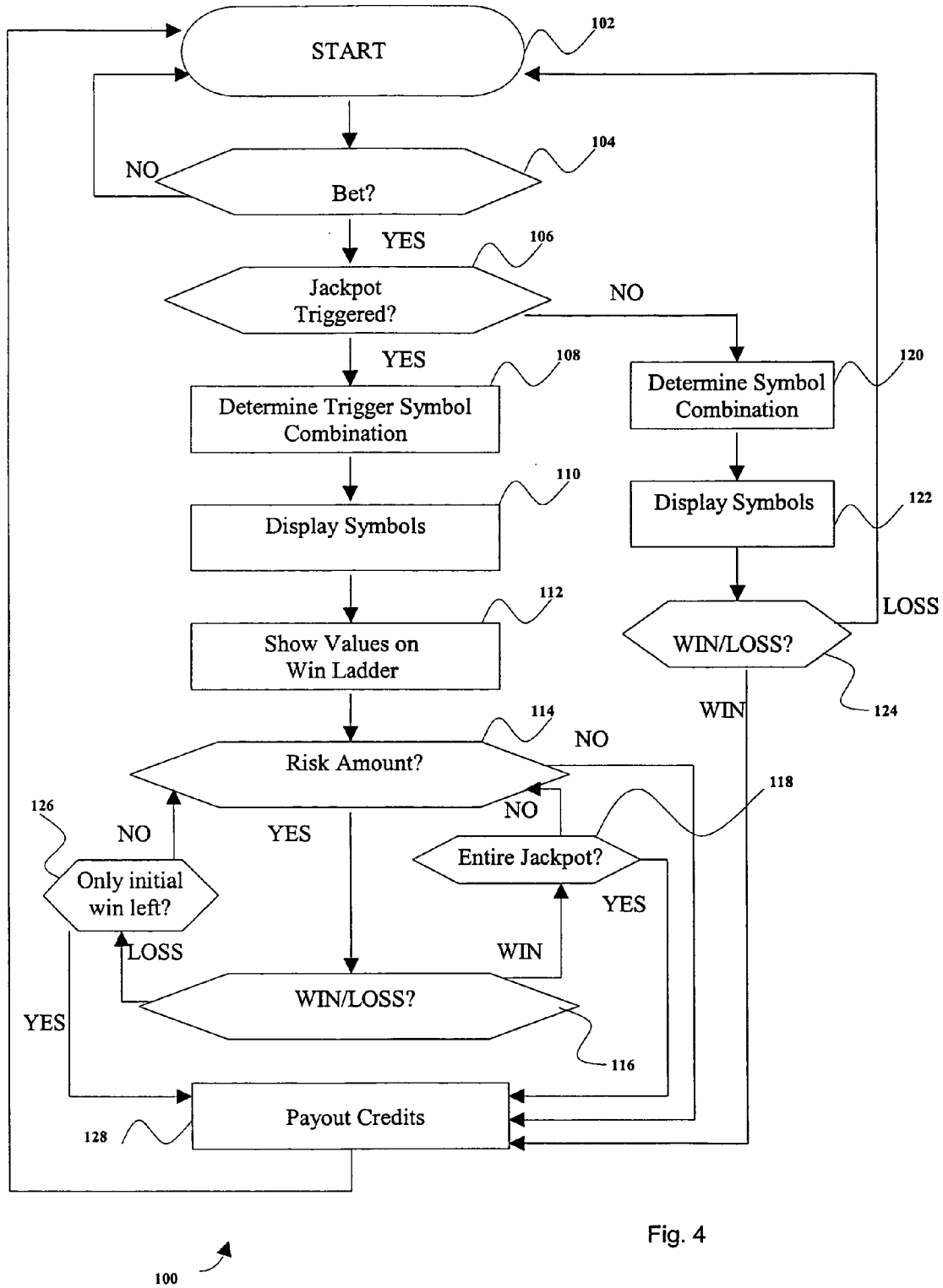
FIG. 4 is a flow chart of a process of determining a jackpot amount in accordance with one embodiment of the present invention.

More detail of one process for playing the gaming device 1 is described in the flowchart 100 of FIG. 4. The process begins at step 102. The master control unit 14 of gaming device 1 detects if there is a bet at step 104. A predetermined part of the bet (e.g., 10%) is used to fill the jackpot system.

In one embodiment, the jackpot system comprises a visible jackpot and at least one background jackpot. The background jackpot is used to at least partially replenish the visible jackpot after a payout. The amount of the visible jackpot is shown on the jackpot display device 7 (FIG. 1). Both the values of the visible jackpot and the background jackpot are stored in the hard disk ROM 14*b*. The ratio of the visible jackpot to the background jackpot is adjustable by the owner/operator of gaming device 1. In one embodiment, the background jackpot is filled with a higher percentage than the visible jackpot.

At step 106, an algorithm, run on control unit 14, determines whether an outcome of the main game (e.g., Blackjack) is to trigger the jackpot. Alternatively, the main game can be run, followed by the determination of a jackpot win.

If there is not to be a triggering for the jackpot at step 106, control unit 14 uses a pseudo random number generator to determine the symbol combination to be displayed, as shown in step 120. This symbol combination is displayed at step 122. At step 124, the control unit 14 determines whether the symbol combination displayed is a winning combination. If the combination results in a win, then credits are paid out at step 128. If the result is a loss, the process loops back and starts over again, at step 102.

Referring back to step 106, if the algorithm determines that a jackpot is to be won, control unit 14 determines, in step 108, the symbol combination to trigger the jackpot game. The different trigger symbol combinations (e.g., ten) are statistically weighted according to their desired probability of occurrence. A coefficient is associated with each triggering symbol combination. The coefficient determines the percentage of the visible jackpot initially awarded. The range of the coefficient is greater than zero and less than or equal to one. Symbol combinations with a lower coefficient offer a smaller portion of the full jackpot.

In step 110, once the trigger symbol combination is determined, it is displayed on CRT 6 (FIG. 1). In step 112, the jackpot win ladder 27 is then displayed in region 23, as shown in FIG. 3. The smallest award on the win ladder has the value "0," and the highest award is the full jackpot value. In-between are a variable number of steps and values on the win ladder 27, ending on the full jackpot value. The full jackpot value may not be known at the moment of the trigger event at step 106, and the numbers to be displayed on the win ladder 27 must be calculated. The award for the player achieving the trigger symbol combination is identified on the win ladder 27 shown in FIG. 3 by, for example, highlighting or flashing the amount.

The word "RISIKO" (or other suitable icon) is also displayed on CRT 6. Thereafter, a player can decide to select the RISIKO icon, by activating control elements 13, to risk the amount won in order to win the next higher award (step 114). If the player loses, he loses the gained award.

If a player decides to risk the amount already won, control unit 14 randomly determines whether the player wins the next award on the win ladder 27 (step 116). In the event of a win, control unit 14 determines whether the player has won the entire jackpot (step 118). If the entire jackpot has been won, then the award is paid out at step 128, and the actual jackpot is replenished using the background jackpot. If the entire jackpot has not been won, the player may choose to again risk the new amount won, at step 114.

In the event of a loss, control unit 14 will determine whether only the initial win amount is left, at step 126. If a player still has more than the initial win amount, then the process will loop back to step 114, and the player may wager again. However, if a player only has the initial award remaining, he will be paid the original number of credits awarded for achieving the trigger symbol combination, at step 128. Thus, in one embodiment, a player will never lose the initial number of credits granted for achieving the trigger symbol combination.

In an alternative embodiment, in the event of a loss, a player may go down one step on the win ladder 27. In this embodiment, the user may lose some of the original number of credits awarded. If the user loses several times, a consolation win displayed on the win ladder 27 may be granted. In yet another embodiment, a player may lose all the initial number of credits awarded.

A pay table displayed on the control console 12 identifies to a player the percentages of the full jackpot corresponding to the various triggering symbol combinations. The win ladder 27 allows the user to know how many games (steps) must be played (and won) to reach the full jackpot award and, if desired, which award is the consolidation award that is granted in a loss situation.

In an alternative embodiment, the various displays and controls may be part of a stand-alone gaming machine for being played by only a single player.

Figure 5:
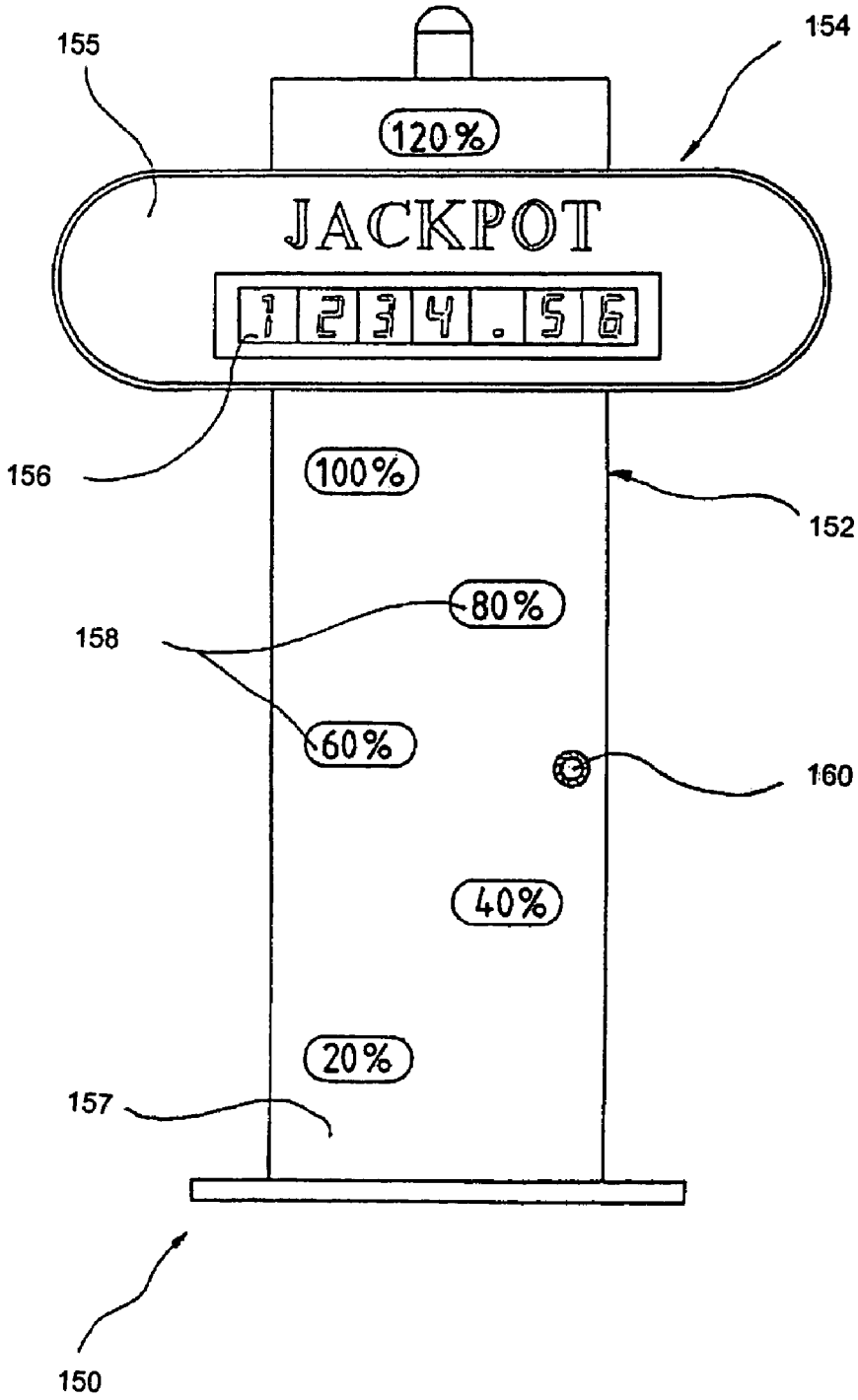
FIG. 5 is a jackpot display device in accordance with another embodiment of the present invention.

FIG. 5 shows an alternative jackpot display 150, which comprises a cabinet 152 and a top portion 154 coupled to the upper part of cabinet 152. Jackpot display 150 may be used with gaming device 1 of FIG. 1, instead of display device 7. Alternatively, jackpot display 150 may be part of an individual gaming terminal that may be played by a single player.

On the front 155 of the top portion 154, there is a digital display 156, which is connected to a control unit (e.g., control unit 14 in FIG. 2). Below top portion 154, there are several transparent backlit display fields 158 which are arranged vertically as a ladder on the front 157 of cabinet 152. A controllable light connected to the control unit is used to provide a backlight for display fields 158. Any type of display may be used.

A control element 160 is also connected to the control unit. Control element 160 may be replaced by one of the control elements 13 shown in FIG. 2.

Jackpot device 150 differs from display 7 (FIG. 1) in that the win ladder 27 shown in FIG. 3 is replaced by a display of percentages of the full jackpot.

When a jackpot is triggered by the main game, the control unit, using a pseudo random number generator, determines the partial amount (a percentage) of the full jackpot award. Alternatively, the partial amount may be determined by the particular triggering symbol combination in the main game. This partial amount may be wagered in the secondary jackpot) game. The partial amount is displayed by the corresponding display field 158.

Using control element 160, or control elements 13 in FIG. 2, the partial award lit on front 157 may be wagered. The control unit randomly determines a win or a loss. In a loss situation, the player will lose the amount wagered or other portion of the amount already won during the jackpot game. In one embodiment, in a loss situation, the player will still retain the initial amount, and the jackpot game will end.

In the event of a win during the jackpot game, the next step on the ladder is illuminated, and a next round is carried out if the player activates the control element 160, assuming the maximum jackpot award has not been achieved. Each time the control element 160 is pressed, the pseudo random number generator determines if the next award on the win ladder is granted. When the player has achieved 100% on the ladder, the full jackpot award is paid. In one embodiment, a win may cause the player to obtain 120% of the displayed full jackpot award. A background jackpot (previously described) may then be used to at least partially replenish the visible jackpot.

Figure 6:
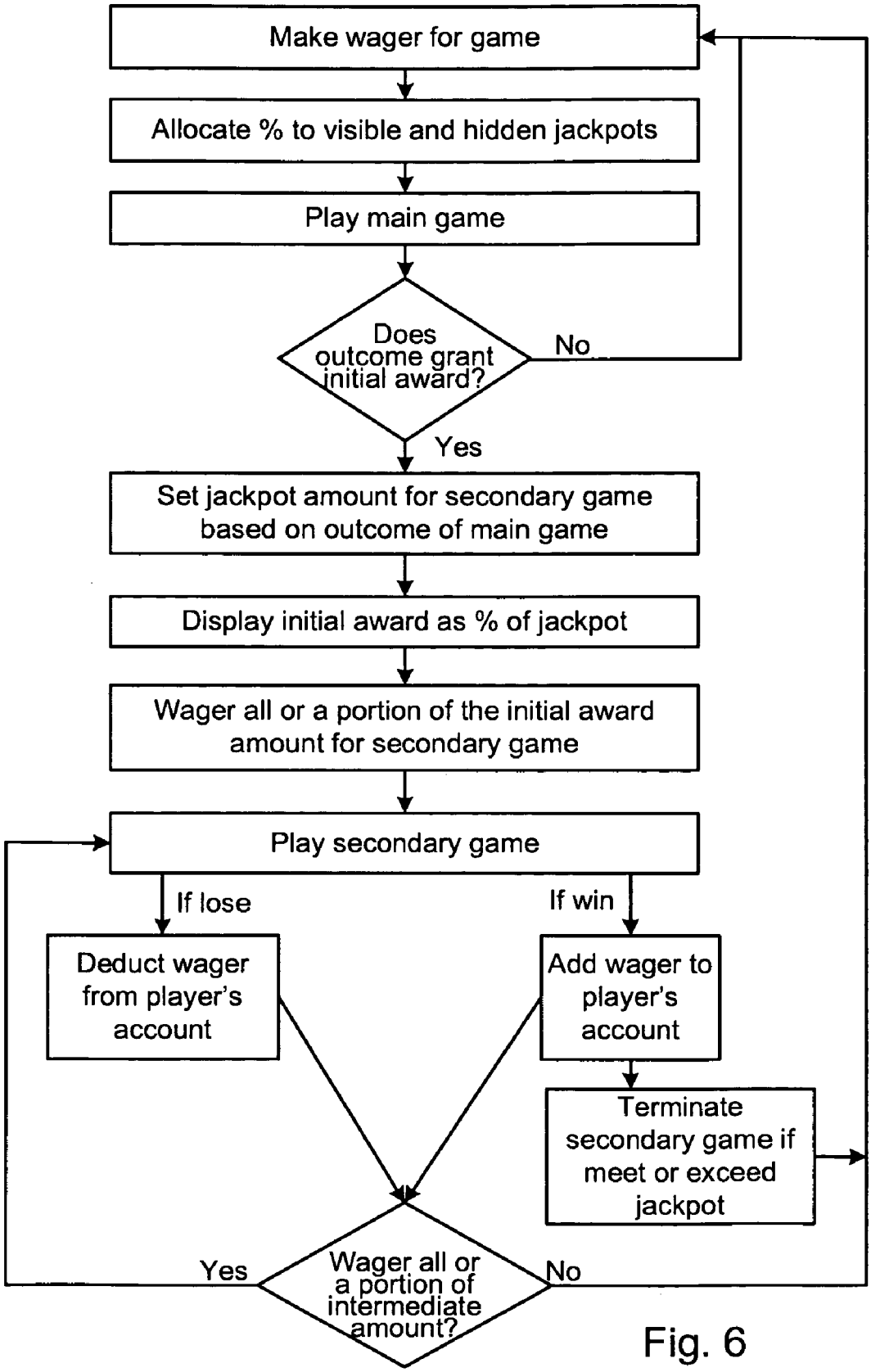
FIG. 6 is a flowchart showing steps performed in one embodiment of the invention.

FIG. 6 is a flowchart showing certain of the above described steps performed in one embodiment of the invention.

Accordingly, the described systems create increased excitement in players by providing increased player interaction and the possibility of higher jackpots. The term "jackpot" is intended to mean any award no matter what the award is called by the gaming machine.

While particular embodiments have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method to determine the value of a jackpot award comprising:

a. operating a main game to obtain one of a plurality of outcomes, at least one of the outcomes enabling the play of a secondary game and awarding a variable initial award amount;

b. determining and displaying a jackpot amount prior to playing a secondary game, the jackpot amount being a maximum award attainable in the secondary game;

c. disylaying a plurality of discrete steps leading to the jackpot amount, each step leading to the jackpot amount displaying a value that is an increasing percentage of the jackpot amount, wherein the initial award amount won in the main game is associated with one of the steps prior to playing the secondary game, said one of the steps being determined by the amount of the initial award amount, a number of successive wins in the secondary game needed to win the jackpot amount being dependent on which step the initial award amount is associated;

d. allowing a player to wager all or a portion of the initial award amount for playing a secondary game;

e. identifying a winning or losing outcome in the secondary game, the winning outcome resulting in an increase of the initial award amount by an incremental amount to obtain an intermediate amount;

f. allowing the player to wager all or a portion of the intermediate amount; and g. identifying a winning or losing outcome in the secondary game, the winning outcome resulting in an increase of the intermediate amount by an incremental amount, with a maximum award being the jackpot amount.

2. The method of claim 1 wherein act d further comprises allowing the player to quit the secondary game and receive the initial award amount.

3. The method of claim 1 wherein act f further comprises allowing the player to quit the secondary game and receive the intermediate amount.

4. The method of claim 1 further comprising terminating the secondary game after the intermediate amount has reached or exceeded the jackpot amount.

5. The method of claim 1 wherein a losing outcome in act e results in a loss of the wager in act d.

6. The method of claim 1 wherein a losing outcome in act g results in a loss of the wager in act f.

7. The method of claim 1 wherein the at least one of the outcomes in act a is associated with a coefficient that determines the initial award amount as a percentage of the jackpot amount.

8. The method of claim 1 wherein the initial award amount is displayed as a percentage of the jackpot amount.

9. The method of claim 1 further comprising displaying the initial award amount, the intermediate amount, and other amounts on a jackpot display device so as to appear to be leading up to the displayed jackpot amount.

10. The method of claim 9 wherein the initial award amount and the intermediate amount are displayed as percentages of the jackpot amount.

11. The method of claim 1 further comprising granting the jackpot award to the player upon the player winning a sufficient number of times in the secondary game.

12. The method of claim 1 wherein, in act f the player is limited to wagering only the initial award amount.

13. The method of claim 1 wherein operating the main game comprises playing a simulated card game on a video screen.

14. The method of claim 1 wherein operating the main game comprises simulating rotating reels on a video screen and randomly stopping the reels to obtain a symbol combination.

15. The method of claim 1 wherein the particular outcome of the main game determines the initial award amount.

16. The method of claim 1 further comprising:

allocating a first percentage of each bet made to play the main game to a jackpot to be displayed to the player;

allocating a second percentage of each bet made to play the main game to a background jackpot that is not displayed to the player; and upon a player winning the jackpot amount, replenishing at least a portion of the jackpot amount from the background jackpot to create an initial jackpot.

17. The method of claim 16 wherein the background jackpot has at least the same value as the jackpot to be displayed to the player.

18. The method of claim 16 wherein the background jackpot is increased by the same percentage as the jackpot to be displayed to the player.

19. The method of claim 16 wherein the background jackpot is increased at a higher percentage than the jackpot to be displayed to the player.

20. The method of claim 1 wherein values on successive steps are about half the value of the next step.

21. A method to determine the value of a jackpot award comprising:

operating a main game to obtain one of a plurality of outcomes, at least one of the outcomes enabling the play of a secondary game and awarding a variable initial award amount;

determining a jackpot amount prior to playing a secondary game, the jackpot amount being a maximum award attainable in the secondary game;

displaying the jackpot amount determined in the step of determining a jackpot amount;

displaying a plurality of discrete steps leading to the jackpot amount, each step leading to the jackpot amount displaying a value that is an increasing percentage of the jackpot amount, wherein the initial award amount won in the main game is associated with one of the steps prior to playing the secondary game, said one of the steps being determined by the amount, a number of successive wins in the secondary game needed to win the jackpot amount being dependent on which step the initial award amount is associated;

allowing a player to wager all or a portion of the initial award amount for playing the secondary game;

identifying a winning or losing outcome in the secondary game, the winning outcome resulting in an increase of the initial award amount by an incremental amount to obtain an intermediate amount;

allowing the player to wager all or a portion of the intermediate amount;

identifying a winning or losing outcome in the secondary game, the winning outcome resulting in an increase of the intermediate amount by an incremental amount, with a maximum award being the jackpot amount; and terminating the secondary game after the intermediate amount has reached the jackpot amount.

22. A gaming device comprising:

a control unit with a microprocessor for operating a main game to obtain one of a plurality of outcomes, at least one of the outcomes causing to be displayed an initial award amount for a secondary game; and a display device for displaying the secondary game, the secondary game comprising:

determining a jackpot amount based on the at least one of the outcomes of the main game, such that the jackpot amount is determined after the main game but prior to playing the secondary game, the jackpot amount being a maximum award attainable in the secondary game, wherein the jackpot amount in the secondary game varies based on the outcome of the main game;

displaying the jackpot amount determined in the step of determining a jackpot amount;

allowing a player to wager all or a portion of the initial award amount for playing the secondary game;

identifying a winning or losing outcome in the secondary game, the winning outcome resulting in an increase of the initial award amount by an incremental amount to obtain an intermediate amount;

allowing the player to wager all or a portion of the intermediate amount; and identifying a winning or losing outcome in the secondary game, the winning outcome resulting in an increase of the intermediate amount by an incremental amount.

23. The device of claim 22 wherein the secondary game further comprises terminating the secondary game after the intermediate amount has reached or exceeded the jackpot amount.

24. A method to determine the value of a jackpot award comprising:

operating a main game to obtain one of a plurality of outcomes, at least one of the outcomes causing to be displayed an initial award amount, at least one of the outcomes enabling play of a secondary game;

determining and displaying a jackpot amount after the main game but prior to playing the secondary game, the jackpot amount being a maximum award attainable in the secondary game, wherein the jackpot amount in the secondary game varies based on the outcome of the main game;

allowing a player to wager a first amount for playing the secondary game;

identifying a winning or losing outcome in the secondary game, the winning outcome resulting in an increase of the initial award amount by the first amount to obtain an intermediate amount;

allowing the player to wager a second amount; and identifying a winning or losing outcome in the secondary game, the winning outcome resulting in an increase of the intermediate amount by the second amount, with a maximum award being the jackpot amount.

25. The method of claim 24 wherein the first amount is the same as the second amount.

26. The method of claim 24 wherein the first amount is different from the second amount.

* * * * *